US010152002B2

(12) United States Patent
Anezaki et al.

(10) Patent No.: US 10,152,002 B2
(45) Date of Patent: Dec. 11, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Takashi Anezaki, Hiratsuka (JP); Kenichi Kaku, Suntou-gun (JP); Taichi Sato, Numazu (JP); Jumpei Kuno, Yokohama (JP); Atsushi Fujii, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/904,055

(22) Filed: Feb. 23, 2018

(65) Prior Publication Data

US 2018/0246441 A1 Aug. 30, 2018

(30) Foreign Application Priority Data

Feb. 28, 2017 (JP) ..... 2017-037735

(51) Int. Cl.

| | |
|---|---|
| ***G03G 5/14*** | (2006.01) |
| ***G03G 15/16*** | (2006.01) |
| ***G03G 15/18*** | (2006.01) |
| ***G03G 15/04*** | (2006.01) |

(52) U.S. Cl.

CPC ..... *G03G 15/162* (2013.01); *G03G 15/04* (2013.01); *G03G 15/18* (2013.01); *G03G 2221/183* (2013.01)

(58) Field of Classification Search

CPC ..... G03G 5/14; G03G 5/142; G03G 5/144

See application file for complete search history.

(56) References Cited

U.S. PATENT DOCUMENTS

| | | | | |
|---|---|---|---|---|
| 4,579,801 | A | 4/1986 | Yashiki | |
| 2013/0344423 | A1 | 12/2013 | Fujii | |
| 2015/0212437 | A1* | 7/2015 | Shida | G03G 5/142 430/56 |
| 2016/0231659 | A1 | 8/2016 | Tanaka et al. | |

FOREIGN PATENT DOCUMENTS

| | | | |
|---|---|---|---|
| EP | 0838729 | A1 | 4/1998 |
| EP | 2317393 | A1 | 5/2011 |
| EP | 2703890 | A1 | 3/2014 |
| JP | 2879084 | B2 | 4/1999 |
| JP | H11109669 | A | 4/1999 |
| JP | 2005017470 | A | 1/2005 |
| JP | 2010030886 | A | 2/2010 |
| JP | 2012018405 | A | 1/2012 |
| JP | 2014160224 | A | 9/2014 |
| WO | 2011/027912 | A | 3/2011 |

OTHER PUBLICATIONS

U.S. Appl. No. 15/903,802, filed Feb. 23, 2018.

* cited by examiner

*Primary Examiner* — Peter L Vajda

(74) *Attorney, Agent, or Firm* — Canon U.S.A., Inc. IP Division

(57) ABSTRACT

An electrophotographic photosensitive member includes a support member, an electroconductive layer, and photosensitive layer in this order. The electroconductive layer contains a binder and particles. The particles have a core containing titanium oxide, and a coating layer coating the core and containing titanium oxide doped with niobium or tantalum.

7 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND

Field of the Disclosure

The present disclosure relates to an electrophotographic photosensitive member, and a process cartridge and an electrophotographic apparatus each including the electrophotographic photosensitive member.

Description of the Related Art

Some of the electrophotographic photosensitive members used in electrophotographic processes have an electroconductive layer containing metal oxide particles between a support member and a photosensitive layer (Japanese Patent Laid-Open Nos. 2014-160224 and 2005-17470). The electroconductive layer acts to relieve the increase of residual potential in image formation and keep dark and bright portion potentials from fluctuating. Japanese Patent Laid-Open No. 2014-160224 discloses an electrophotographic photosensitive member including an electroconductive layer containing tin oxide particles coated with niobium- or tantalum-doped tin oxide. Japanese Patent Laid-Open No. 2005-17470 discloses an electrophotographic photosensitive member including an intermediate layer containing titanium oxide pigment containing niobium.

In recent years, it has been desired that electrophotographic processes output high-definition images. Accordingly, an electrophotographic photosensitive member that helps improve the definition of output images is desired.

SUMMARY

Accordingly, there is provided herein, an electrophotographic photosensitive member including a support member, an electroconductive layer, and a photosensitive layer in this order. The electroconductive layer contains a binder and particles. The particles have a core containing titanium oxide, and a coating layer coating the core and containing titanium oxide doped with niobium or tantalum.

According to another aspect, there is provided a process cartridge capable of being removably attached to an electrophotographic apparatus. The process cartridge includes the electrophotographic photosensitive member and at least one device selected from the group consisting of a charging device, a developing device, a transfer device, and a cleaning device. The electrophotographic photosensitive member and the at least one device are held in one body.

Also, an electrophotographic apparatus is provided which includes the above-described electrophotographic photosensitive member, a charging device, an exposure device, a developing device, and a transfer device.

The electrophotographic photosensitive member according to the present disclosure can output high-definition images and, in addition, can reduce potential fluctuation at dark and bright portions in repeated use.

Further features of the present disclosure will become apparent from the following description of exemplary embodiments with reference to the attached drawings.

DESCRIPTION OF THE EMBODIMENTS

Figure 1:
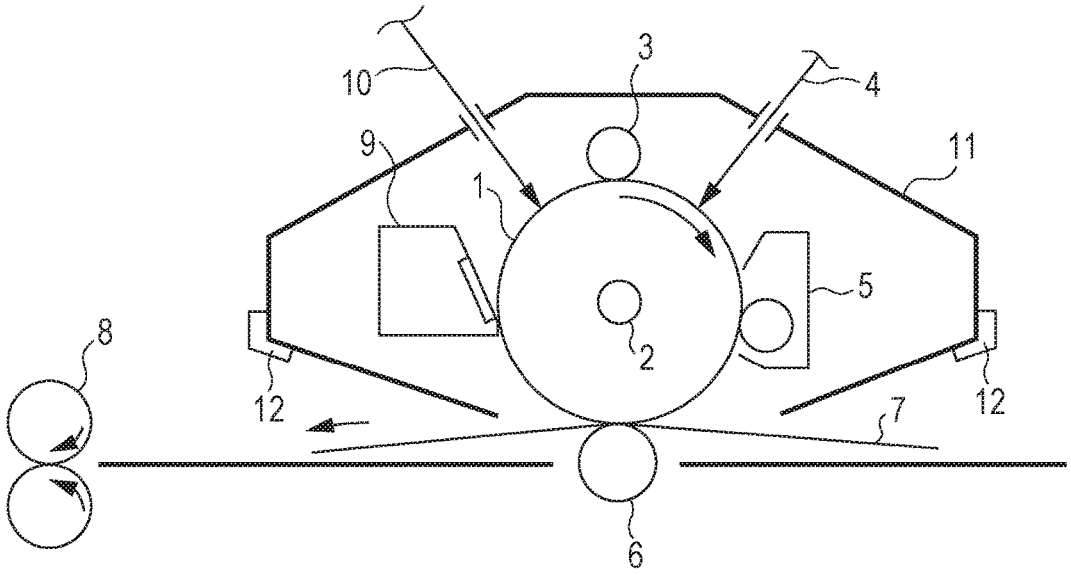
FIG. 1 is a schematic view of the structure of an electrophotographic apparatus provided with a process cartridge including as electrophotographic photosensitive member, according to one or more aspect of the subject disclosure.

According to an investigation by the present inventors, the electrophotographic photosensitive member disclosed in Japanese Patent Laid-Open No. 2014-160224 improves reducing potential fluctuation at dark and bright portions in repeated use, but further refinement in definition of output images is greatly needed and desired. Also, in the electrophotographic photosensitive member disclosed in Japanese Patent Laid-Open No. 2005-17470,a further refinement is desired in reducing potential fluctuation at dark and bright portions in repeated use.

Accordingly, the present disclosure provides an electrophotographic photosensitive member that can output high-definition images and, in addition, can reduce potential fluctuation at dark and bright portions in repeated use.

The subject matter of the present disclosure will be described in detail in exemplary embodiments.

Light that has entered the photosensitive layer of an electrophotographic photosensitive member is reflected at the layer underlying the photosensitive layer (layer that image exposure light reaches after passing through the photosensitive layer) or the interface between the photosensitive layer and the support member, or scattered within the layer underlying the photosensitive layer. The present inventors have found that in the electrophotographic photosensitive member disclosed in Japanese Patent Laid-Open No. 2014-160224, the area of the photosensitive layer to be irradiated with image exposure light is substantially increased by the reflection or scattering just described, consequently reducing the definition of the latent image and resulting in a reduced definition of the output image. This problem occurs notably when a pattern or image having dots at such intervals that image exposure light does not overlap is formed.

Also, it has been found that when the electrophotographic photosensitive member disclosed in Japanese Patent Laid-Open No. 2005-17470 is repeatedly used, potentials at dark and bright portions fluctuate because an electroconductive layer having an appropriate electric resistance is not formed.

From the viewpoint of solving such issues, the present inventors have conducted research into metal oxide particles used in the electroconductive layer and found that metal oxide particles having a core containing titanium oxide, and a coating layer coating the core and containing titanium oxide doped with niobium or tantalum are useful for solving the issues occurring in the know art.

The titanium oxide particle used in the present disclosure has a core containing titanium oxide, and a coating layer coating the core and containing titanium oxide doped with niobium or tantalum. If particles containing titanium oxide but not coated with such a coating layer are used, a mass of the particles itself has a high powder resistance, and the resistance of the electroconductive layer increases accordingly. Japanese Patent Laid-Open No. 2005-17470 discloses titanium oxide particles containing niobium (but not having a coating layer, unlike the present disclosure). The present inventors have found that, in this instance, the resistance of the electroconductive layer does not decrease satisfactorily even though the particles contain niobium, and that potential fluctuation at the dark and bright portions in repeated use cannot be satisfactorily reduced.

On the other hand, the use of specific particles disclosed herein satisfactorily reduces the resistance of the electroconductive layer, and accordingly enables a high level of reduction of potential fluctuation at the dark and bright portions in repeated use.

The core and coating layer of the particles disclosed herein each contain titanium oxide. Titanium oxide has a higher refractive index than tin oxide, which is used in the above-cited known art. If particles of a substance having a high refractive index are used in the electroconductive layer, the particles hinder image exposure light that has entered the photosensitive member and passed through the photosensitive layer from entering the electroconductive layer and help the light reflect or scatter at the interface of the electroconductive layer with the photosensitive layer. As light scatters in the electroconductive layer at a larger distance from the interface with photosensitive layer, a larger area of the photosensitive layer is irradiated with image exposure light, and accordingly, the definition of the latent image is reduced, and the definition of the resulting output image is reduced. On the other hand, the specific particles disclosed herein suppress the decrease in definition of the latent image and increase the definition of the output image.

Furthermore, the present inventors compared the case of using titanium oxide particles having no coating layer with the case of using the titanium oxide particles disclose herein, each having a coating layer. As a result, the definition of the output image was improved when the coated titanium oxide particles are used. This is probably because the titanium oxide particles disclosed herein have a coating layer and a core that have different refractive indices and, accordingly, the apparent refractive index of the titanium oxide particles varies.

Synergistic interaction between components or members of the electrophotographic photosensitive member produces beneficial effects as intended, as described above.

Electrophotographic Photosensitive Member

The electrophotographic photosensitive member disclosed herein includes a support member, an electroconductive layer, and a photosensitive layer in this order.

The electrophotographic photosensitive member may be manufactured by applying each of the coating liquids prepared for forming the respective layers, which will be described later, in a desired order, and drying the coatings. Each coating liquid may be applied by dip coating, spray coating, ink jet coating, roll coating, die coating, blade coating, curtain coating, wire bar coating, ring coating, or any other method. In an embodiment, dip coating may be employed from the viewpoint of efficiency and productivity. The layers of the electrophotographic photosensitive member will now be described.

Support Member

The electrophotographic photosensitive member disclosed herein includes a support member. Beneficially, the support member is electrically conductive. The support member may be in the form of a cylinder, a belt, sheet, or the like. A cylindrical support member is beneficial. The support member may be surface-treated by electrochemical treatment, such as anodization, or blasting, centerless polishing, or cutting.

The support member may be made of a metal, a resin, or glass. For a metal support member, the metal may be selected from among aluminum, iron, nickel, copper, gold, stainless steel, and alloys thereof. An aluminum support member is beneficial. If the support member is made of a resin or glass, an electrically conductive material may be added into or applied over the support member to impart an electrical conductivity.

Electroconductive Layer

The electroconductive layer is disposed over the support member and contains a binder and particles having a core containing titanium oxide, and a coating layer coating the core and containing titanium oxide doped with niobium or tantalum.

The core may be spherical, polyhedral, elliptical, flaky, needle-like, or the like. From the viewpoint of reducing image defects such as black spots, a spherical, polyhedral, or elliptical core is beneficial. More beneficially, the core has a spherical shape or a polyhedral shape close to a sphere.

The core of the particles disclosed herein may contain anatase or rutile titanium oxide. Beneficially, the core contains anatase titanium oxide. More beneficially, the core is made f anatase titanium oxide. Anatase titanium oxide reduces the potential fluctuation at dark and bright portions.

The particles may have an average primary particle size in the range of 50 nm to 500 nm. Particles having an average primary particle size of 50 nm or more are unlikely to aggregate in the coating liquid prepared for forming the electroconductive layer (hereinafter may be referred to as electroconductive layer-forming coating liquid). Aggregates of the particles in the coating liquid reduce the stability of the coating liquid and cause the resulting electroconductive layer to crack in the surface thereof. If particles having an average primary particle size of 50 nm or less are used, the surface of the resulting electroconductive layer is unlike to become rough. A rough surface of the electroconductive layer easily causes local charge injection into the photosensitive layer. Consequently, black spots are likely to become noticeable in a white or blank area in the output image. More beneficially, the average primary particle size of the particles is in the range of 100 nm to 400 nm.

The average particle size (D1) mentioned herein is a value measured as below with a scanning electron microscope. Particles to be measured are observed under a scanning electron microscope S-4800 (manufactured by Hitachi), and the particle sizes of 100 particles randomly selected from an image obtained by the observation are averaged as the primary average particle size D1 of the particles. The particle size of each primary particle having a longest edge length a and a smallest edge length b is defined by (a+b)/2. For needle-like or flaky metal oxide particles, the average particle size is defined by each of the longer axis length and the shorter axis length.

The content of dopant, or niobium or tantalum, added to the titanium oxide in the coating layer is in the range of 0.5% by mass to 10.0% by mass relative to the total mass of the coating layer. If the dopant content is less than 0.5% by mass, the potential fluctuation at dark and bright portions may not be sufficiently reduced in some cases. In contrast, if the dopant content is higher than 10.0% by mass, leak current may often occur in the electrophotographic photosensitive member. In an embodiment, the do ant content may be in the range of 1.0% by mass to 7.0% by mass relative to the total mass of the coating layer.

The average diameter of the core may be 1 time to 50 times, beneficially 5 times to 20 times, as large as the average thickness of the coating layer. Such particles are beneficial for producing still higher-definition images. In an embodiment, the average thickness of the coating layer may be 5 nm or more.

In an embodiment, the particles may be surface-treated with a silane coupling agent or the like.

In some embodiments, the particle content in the electroconductive layer may be in the range of 20% by volume to 50% by volume relative to the total volume of the electroconductive layer. When the particle content is less than 20% by volume, the distance between the particles increases and, accordingly, the volume resistivity of the electroconductive layer tends to increase. In contrast, when the particle content is more than 50% by volume, the distance between the particles decreases and, accordingly, the particles become likely to come into contact with each other. In this instance, particles in contact with each other locally reduce the volume resistivity of the electroconductive layer, tending to cause leakage in the electrophotographic photosensitive member. In some embodiments, the particle content in the electroconductive layer may be in the range of 30% by volume to 45% by volume relative to the total volume of the electroconductive layer.

In an embodiment, the electroconductive layer may further contain a different type of electrically conductive particles. The material of the further added electrically conductive particles may be a metal oxide, a metal, carbon black, or the like.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

If metal oxide particles are used as the further added electrically conductive particles, these particles may be surface-treated with a silane coupling agent or the like or doped with an element such as phosphorus or aluminum or oxide thereof.

The further added electrically conductive particles may have a core and a coating layer coating the core. The core may be made of titanium oxide, barium sulfate, zinc oxide, or the like. The coating layer may be made of a metal oxide, such as tin oxide.

If metal oxide particles are used as the further added electrically conductive particles other than the specific particles disclosed herein, the metal oxide particles may have a volume average particle size in the range of 1 nm to 500 nm, such as in the range of 3 nm to 400 nm.

The binder resin contained in the electroconductive layer may be of polyester resin, polycarbonate resin, polyvinyl acetal resin, acrylic resin, silicone resin, epoxy resin, melamine resin, polyurethane resin, phenol resin, or alkyd resin. In an embodiment, the binder may be of a thermosetting phenol resin or thermosetting polyurethane resin. If a thermosetting resin is used as the binder, the binder added in the coating liquid for forming the electroconductive layer is in the form of a monomer and/or an oligomer of the thermosetting resin.

The electroconductive layer may further contain silicone oil, resin particles, or the like.

The average thickness of the electroconductive layer may be in the range of 0.5 μm to 50 μm, such as 1 μm to 40 μm or 5 μm to 35 μm.

In some embodiments, the volume resistivity of the electroconductive layer may be in the range of $1.0\times10^{7}$ Ω·cm to $5.0\times10^{12}$ Ω·cm. The electroconductive layer having a volume resistivity of 5.0×10 Ω·cm or less can help charge to flow smoothly and suppress increase in residual resistance and potential fluctuation at dark and bright portions when an image is formed. Also, the electroconductive layer having a volume resistivity of $1.0\times10^{7}$ Ω·cm or more can suppress excessive flow of charge in the electroconductive layer and leakage in the electrophotographic photosensitive member when the electrophotographic photosensitive member is charged. In an embodiment, the volume resistivity of the electroconductive layer may be in the range of 1.0×10 Ω·cm to 1.0×10 Ω·cm.

Figure 2:
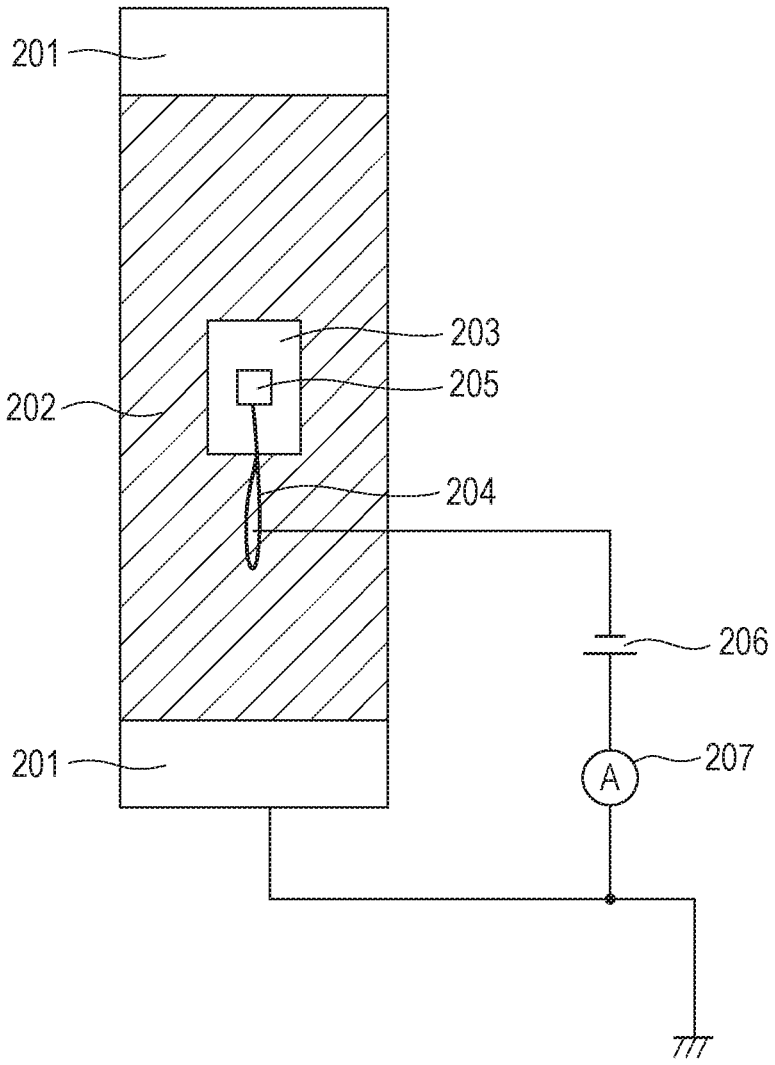
FIG. 2 is a top view of an electroconductive layer, illustrating a method for measuring the volume resistivity of the electroconductive layer, according to one or more aspect of the subject disclosure.
Figure 3:
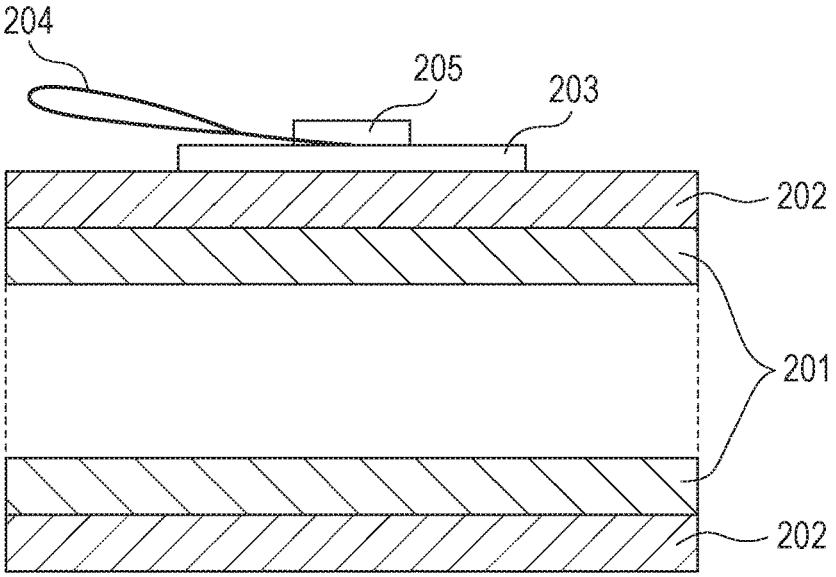
FIG. 3 is a sectional view of an electroconductive layer, illustrating a method for measuring the volume resistivity of the electroconductive layer, according to one or more aspect of the subject disclosure.

A method for measuring the volume resistivity of the electrophotographic photosensitive member will be described with reference to FIGS. 2 and 3. FIG. 2 is a top view of an electroconductive layer, illustrating a method for measuring the volume resistivity of the electroconductive layer, and FIG. 3 is a sectional view of the electroconductive layer, illustrating the method.

The volume resistivity of the electroconductive layer is measured at normal temperature and normal humidity (temperature: 23° C., relative humidity: 50%). A copper tape 203 (product code No. 1181, manufactured by 3M) is stuck to the surface of the electroconductive layer 202. This tape is used as the front side electrode of the electroconductive layer 202. The support member 201 is used as the rear side electrode of the electroconductive layer 202. A power supply 206 from which a voltage is applied between the copper tape 203 and the support member 201 and a current measuring device 207 for measuring the current flowing between the copper tape 203 and the support member 201 are provided. For applying a voltage to the copper tape 203, a copper wire 204 put on the copper tape 203 and fixed so as not to come off from the copper tape 203 by sticking another copper tape 205 onto the copper tape 203. A voltage is applied to the copper tape 203 through the copper wire 204.

The volume resistivity ρ(Ω·cm) of the electroconductive layer 202 is defined by the equation: $\rho=1/(I-I_0)\times S/d$, wherein $I_0$ represents the background current (A) when no current is applied between the copper tape 203 and the support member 201, I represents the current (A) when only a direct voltage (direct component) of −1 V is applied between the copper tape 203 and the support member 201, d represents the thickness (cm) of the electroconductive layer 202, and S represents the area ($cm^2$) of the front side electrode or copper tape 203 on the front side of the electroconductive layer 202.

The current measuring device 207 used for this measurement is beneficially capable of measuring very small current. In this measurement, a current as small as $1\times10^{-6}$ A or less in terms of absolute value is measured. Such a current measuring device may be, for example, pA meter 4140B manufactured by Hewlett-Packard. The volume resistivity of the electroconductive layer may be measured in a state where only the electroconductive layer is formed on the support member, or in a state where only the electroconductive layer is left after the overlying layers (including the photosensitive layer) have been removed from the electrophotographic photosensitive member. Either case obtains the same measurement value.

In an embodiment, a mass of the particles may have a volume resistivity (powder resistivity) in the range of 1.0×10 Ω·cm to 1.0×10 Ω·cm. When the powder resistivity is in this range, the electroconductive layer is likely to have a volume resistivity in the above-described range. In an embodiment, the powder resistivity of the particles may be in the range of $1.0\times10^{2}$ Ω·cm to 1.0×10 Ω·cm. The powder resistivity of the particles is measured at normal temperature and normal humidity (temperature: 23° C., relative humidity: 50%). Powder resistivity mentioned herein is the value measured with a resistivity meter Loresta GP manufactured by Mitsubishi Chemical Analytech. For this measurement, particles to be measured are pressed into a pellet at a pressure of 500 $kg/cm^2$, and the pellet is measured at an applied voltage of 100 V.

The electroconductive layer may be formed by applying an electroconductive layer-forming coating liquid containing the above-described ingredients and a solvent to form a coating film, followed by drying. The solvent of the coating liquid may be an alcohol-based solvent, a sulfoxide-based solvent, a ketone-based solvent, an ether-based solvent, an ester-based solvent, or an aromatic hydrocarbon. The metal oxide particles are dispersed in the coating liquid by using, for example, a paint shaker, a sand mill, ball mill, or a high-speed liquid collision disperser. The thus prepared coating liquid may be filtered to remove unnecessary impurities.

Undercoat Layer

In an embodiment, an undercoat layer may be disposed on the electroconductive layer. The undercoat layer enhances the adhesion between layers and blocks charge injection.

The undercoat layer may contain a resin. The undercoat layer may be a cured film formed by polymerizing a composition containing a monomer having a polymerizable functional group.

Examples of the resin contained in the undercoat layer include polyester resin, polycarbonate resin, polyvinyl acetal resin, acrylic resin, epoxy resin, melamine resin, polyurethane resin, phenol resin, polyvinylphenol resin, alkyd resin, polyvinyl alcohol resin, polyethylene oxide resin, polypropylene oxide resin, polyamide resin, polyamide acid resin, polyimide resin, poly(amide-imide) resin, and cellulose resin.

Examples of the polymerizable functional group of the monomer include an isocyanate group, blocked isocyanate groups, a methylol group, alkylated methylol groups, and an epoxy group, metal alkoxide groups, a hydroxyl group, an amino group, carboxy group, a thiol group, a carboxy anhydride group, and a carbon-carbon doubly bond.

The undercoat layer may further contain an electron transporting material, a metal oxide, a metal, or an electrically conductive polymer from the viewpoint of increasing the electrical properties thereof. In an embodiment, an electron transporting material or a metal oxide may be added.

Examples of the electron transporting material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The undercoat layer may be a cured film formed by polymerizing an electron transporting material slaving a polymerizable functional group with any of the above-cited monomers having a polymerizable functional group.

Examples of the metal oxide added into the undercoat layer include indium tin oxide, tin oxide, indium oxide, titanium oxide, zinc oxide, aluminum oxide, and silicon dioxide. The metal added into the undercoat layer may be gold, silver, or aluminum. The undercoat layer may further contain an additive.

The average thickness of the undercoat layer may be in the range of 0.1 μm to 50 μm, such as 0.2 μm to 40 μm or 0.3 μm to 30 μm.

The undercoat layer may be formed by applying an undercoat layer-forming coating liquid containing the above-described ingredients and a solvent to form a coating film, followed by drying and/or curing. The solvent of the undercoat layer-forming coating liquid may be an alcohol-based solvent, a ketone-based solvent, an ether-based solvent, an ester-based solvent, or an aromatic hydrocarbon.

Photosensitive Layer

The photosensitive layer may be: (1) a multilayer photosensitive layer; or (2) a sin layer photosensitive layer. (1) The multilayer photosensitive layer includes a charge generating layer containing a charge generating material, and a charge transport layer containing a charge transporting material. (2) The single-layer photosensitive layer is a photosensitive layer containing a charge generating material and a charge transporting mater together.

(1) Multilayer Photosensitive Layer

The multilayer photosensitive layer includes a charge generating layer and a charge transport layer.

(1-1) Charge Generating Layer

The charge generating layer may contain a charge generating material and a resin.

Examples of the charge generating material include azo pigments, perylene pigments, polycyclic quinone pigments, indigo pigments, and phthalocyanine pigments. Among these, azo pigments and phthalocyanine pigments are beneficial. An oxytitanium phthalocyanine pigment, a chlorogallium phthalocyanine pigment, or a hydroxygallium phthalocyanine pigment may be used as the phthalocyanine pigment.

The charge generating material content in the charge generating layer may be in the range of 40% by mass to 85% by mass, such as in the range of 60% by mass to 80% by mass, relative to the total mass of the charge generating layer.

Examples of the resin contained in the charge generating layer include polyester resin, polycarbonate resin, polyvinyl acetal resin, polyvinyl butyral resin, acrylic resin, silicone resin, epoxy resin, melamine resin, polyurethane resin, phenol resin, polyvinyl alcohol resin, cellulose resin, polystyrene resin, polyvinyl acetate resin, and vinyl chloride resin. Among these, polyvinyl butyral resin is beneficial.

The charge generating layer may further contain an antioxidant, a UV absorbent, or any other additive. Examples of such an additive include hindered phenol compounds, hindered amine compounds, sulfur compounds, phosphorus compounds, and benzophenone compounds.

The thickness of the charge generating layer may be in the range of 0.1 μm to 1 μm, such as in the range of 0.15 μm to 0.4 μm.

The charge generating layer may be formed by applying a coating liquid containing the above-described ingredients and a solvent to form a coating film, followed by drying. The solvent of the coating liquid for the charge generating layer may be an alcohol-based solvent, a sulfoxide-based solvent, a ketone-based solvent, an ether-based solvent, an ester-based solvent, or an aromatic hydrocarbon.

(1-2) Charge Transport Layer

The charge transport layer may contain a charge transporting material and a resin.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. Triarylamine compounds and benzidine compounds are beneficial.

The charge transporting material content in the charge transport layer may be in the range of 25% by mass to 70% by mass, such as in the range of 30% by mass to 55% by mass, relative to the total mass of the charge transport layer.

The resin contained in the charge transport layer may be a polyester resin, a polycarbonate resin, an acrylic resin, or a polystyrene resin. In an embodiment, a polycarbonate resin or a polyester resin may be used. For example, a polyarylate resin may be used as the polyester resin.

The mass ratio of the charge transporting material to the resin may be in the range of 4:10 to 20:10, such as 5:10 to 12:10.

The charge transport layer may further contain an antioxidant, a UV absorbent, a plasticizer, a leveling agent, a lubricant, an abrasion resistance improver, and any other additive. More specifically, examples of such an additive include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The average thickness of the charge transport may be in the range of 5 μm to 50 μm, such as 8 μm to 40 μm or 9 μm to 30 μm.

The charge transport layer may be formed by applying a charge transport layer-forming coating liquid containing the above-described ingredients and a solvent to form a coating film, followed by drying. The solvent of the charge transport layer-forming coating liquid may be an alcohol-based solvent, a ketone-based solvent, an ether-based solvent, an ester-based solvent, or an aromatic hydrocarbon. In an embodiment, an ether-based solvent or an aromatic hydrocarbon may be used as the solvent.

(2) Single-Layer Photosensitive Layer

The single-layer photosensitive layer may be formed by applying a coating liquid containing a charge generating material, charge transporting material, a resin, and a solvent to form a coating film, followed by drying. The charge generating material, the charge transporting material, and the resin may be selected from among the same materials cited in "(1) Multilayer Photosensitive Layer".

Protective Layer

The photosensitive layer may be covered with a protective layer. The protective layer enhances durability.

The protective layer may contain electrically conductive particles and/or a charge transporting material and a resin.

The electrically conductive particles may be those of a metal oxide, such as titanium oxide, zinc oxide, tin oxide, or indium oxide.

Examples of the charge transporting mater include polycyclic aromatic compounds, heterocyclic compounds, hydrazone compounds, styryl compounds, enamine compounds, benzidine compounds, triarylamine compounds, and resins having a group derived from these compounds. Triarylamine compounds and benzidine compounds are beneficial.

Examples of the resin contained in the protective layer include polyester resin, acrylic resin, phenoxy resin, polycarbonate resin, polystyrene resin, phenol resin, melamine resin, and epoxy resin. In an embodiment, a polycarbonate resin, a polyester resin, or an acrylic resin may be used.

The protective layer may be a cured film formed by polymerizing a composition containing a monomer having a polymerizable functional group. In this instance, a thermal polymerization reaction, a photopolymerization reaction, radiation polymerization reaction, or the like may be conducted. The polymerizable functional group of the monomer may be an acryloyl group or a methacryloyl group. The monomer having a polymerizable functional group may have a charge transporting function.

The protective layer may further contain an antioxidant, a UV absorbent, a plasticizer, a leveling agent, a lubricant, an abrasion resistance improver, and any other additive. More specifically, examples of such an additive include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The thickness of the protective layer may be in the range of 0.5 μm to 10 μm, such as in the range of 1 μm to 7 μm.

The protective layer may be formed by applying a coating liquid containing the above-described ingredients and a solvent to form a coating film, followed by drying and/or curing. The solvent of the coating liquid for the protective layer may be an alcohol-based solvent, a ketone-based solvent, an ether-based solvent, sulfoxide-based solvent, an ester-based solvent, or an aromatic hydrocarbon.

Process Cartridge and Electrophotographic Apparatus

The process cartridge according to an embodiment of the present disclosure is removably mounted to an electrophotographic apparatus and includes the above-described electrophotographic photosensitive member and at least one device selected from the group consisting of a charging device, a developing device, a transfer device, and a cleaning device. The electrophotographic photosensitive member and these devices are held in one body.

Also, the electrophotographic apparatus according to an embodiment of the present disclosure includes the above-described electrophotographic photosensitive member, a charging device, an exposure device, a developing device, and a transfer device.

FIG. 1 is a schematic view of the structure of an electrophotographic apparatus provided with a process cartridge including an electrophotographic photosensitive member.

The electrophotographic photosensitive member designated by reference numeral 1 is cylindrical and is driven for rotation on an axis 2 in the direction indicated by an arrow at a predetermined peripheral speed. The surface of the electrophotographic photosensitive member 1 is charged to a predetermined positive potential or negative potential with a charging device 3. Although the charging device 3 is of roller type for roller charging in the embodiment shown in FIG. 1, the charging device may be a type for corona charging, proximity charging, injection charging, or the like in another embodiment. An electrostatic latent image corresponding to targeted image information is formed on the surface of the charged electrophotographic photosensitive member 1 by irradiation with exposure light 4 from an exposure device (not shown). The electrostatic latent image formed on the surface of the electrophotographic photosensitive member 1 is developed into a toner image with a toner contained in a developing device 5. The toner image on the surface of the electrophotographic photosensitive member 1 is transferred to a transfer medium 7 by a transfer device 6. The transfer medium 7 to which the toner image has been transferred is conveyed to a fixing device 8 for fixing the toner image, thus being ejected as an output image from the electrophotographic apparatus. The electrophotographic apparatus may include a cleaning device 9 for removing or the like remaining on the electrophotographic photosensitive member 1 after transfer. Alternatively, what is called a cleanerless system in which the developing device or the like acts to remove the toner or the like may be implemented without using a cleaning device. The electrophotographic apparatus may include a static elimination mechanism operable to remove static electricity from the surface of the electrophotographic photosensitive member 1 with pre-exposure light 10 from a pre-exposure device (not shown). Also, the electrophotographic apparatus may nave a guide 12, such as a rail, that guides the removal or attachment of the process cartridge.

The electrophotographic photosensitive member of the present disclosure may be used in a laser beam printer, an LED printer, a copy machine, a facsimile, or a multifunctional machine having functions of those apparatuses.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Preparation of Metal Oxide Particles

Metal Oxide Particles 1

Anatase titanium dioxide that is the material of the cores of the particles may be prepared by a known sulfate method. More specifically, a solution containing titanium sulfate and titanyl sulfate may be heated for hydrolysis to prepare metatitanic acid slurry. The slurry is dehydrated and fired to yield anatase titanium dioxide. The resulting anatase titanium oxide contains niobium. This niobium is derived from ilmenite ore or the like used as the raw material of titanyl sulfate. The niobium content may be adjusted by adding niobium sulfate or any other niobium compound into an aqueous solution of hydrous titanium dioxide slurry prepared by hydrolysis of a titanyl sulfate aqueous solution. In the Example disclosed here, anatase titanium dioxide whose niobium content had been adjusted as just described was used.

Substantially spherical anatase titanium dioxide particles containing 0.20% by weight of niobium having an average primary particle size of 150 nm were used as the cores. The core particles (100 g) was dispersed in water to prepare 1 L of aqueous suspension, followed by heating to 60° C. To this aqueous suspension were simultaneously dropped (parallelly added) a titanium-niobium acid solution, which was prepared by mixing a niobium solution prepared by dissolving 3 g of niobium pentachloride ($NbCl_5$) in 100 mL of 11.4 mol/L hydrochloric acid with 600 mL of titanium sulfate solution containing 33.7 g of Ti, and 10.7 mol/L sodium hydroxide solution over a period of 3 hours so that the suspension had a pH of 2 to 3. After dropping, the suspension was filtered, and the product was rinsed and dried at 110° C. for 8 hours. The dried product was heated at 800° C. in air for 1 hour to yield metal oxide particles 1 having a core containing titanium oxide, and a coating layer containing niobium-doped titanium oxide.

Metal Oxide Particles 2 to 9 and 12 to 16

Metal oxide particles 2 to 9 and 12 to 16 as shown in Table 1 were prepared in the same manner as metal oxide particles 1 except that the average primary particle size of the cores and the conditions for forming the coating layer were changed.

Metal Oxide Particles 10

Metal oxide particles 10 were prepared in the same manner as metal oxide particles 1 except that substantially spherical rutile titanium dioxide containing 0.20% by weight of niobium was used as the core material.

Metal Oxide Particles 11

Metal oxide particles 11 were prepared in the same manner as metal oxide particles 1 except that needle-like anatase titanium dioxide particles having a longer axis length of 300 nm and a shorter axis length of 20 nm were used as the core material.

Metal Oxide Particles 17

Metal oxide particles 17 were prepared in the same manner as metal oxide particles 1 except that substantial anatase titanium dioxide containing 0.05% by weight of niobium was used as the core material.

Metal Oxide Particles 18

The powder of metal oxide particles 1 in a proportion of 100 parts was mixed with 500 parts of toluene with stirring, and 1.25 parts of N-2-(aminoethyl)-3-aminopropylmethoxysilane KBM603 (produced by Shin-Etsu Chemical) was added into the mixture, followed stirring for 2 hours. After removing toluene by vacuum distillation, the product was fired at 120° C. for 3 hours to yield metal oxide particles 18 surface-treated with a s lane coupling agent.

Metal Oxide Particles C1

Metal oxide particles C1 were prepared in the same manner as metal oxide particles 1 except that substantially spherical anatase titanium dioxide particles were not coated with a coating layer. The niobium content in the particles was 0.2% by mass relative to the total mass of the particles.

TABLE 1

| | | Coating layer | | Particles in a mass | |
|---|---|---|---|---|---|
| Metal oxide particles | Core Crystalline form of core material | Dopant of coating layer | Dopant content in coating layer (mass %) | Powder resistivity (Ω · cm) | Average primary particle size D1 (nm) |
| Metal oxide particles 1 | Anatase | Niobium | 5.0 | $8 \times 10^3$ | 170 |
| Metal oxide particles 2 | Anatase | Niobium | 5.0 | $5 \times 10^3$ | 180 |
| Metal oxide particles 3 | Anatase | Niobium | 5.0 | $2 \times 10^3$ | 190 |
| Metal oxide particles 4 | Anatase | Niobium | 5.0 | $1 \times 10^4$ | 158 |
| Metal oxide particles 5 | Anatase | Niobium | 5.0 | $1 \times 10^5$ | 155 |
| Metal oxide particles 6 | Anatase | Niobium | 0.5 | $4 \times 10^4$ | 170 |
| Metal oxide particles 7 | Anatase | Niobium | 0.1 | $2 \times 10^5$ | 170 |
| Metal oxide particles 8 | Anatase | Niobium | 10.0 | $2 \times 10^3$ | 170 |
| Metal oxide particles 9 | Anatase | Niobium | 15.0 | $5 \times 10^2$ | 170 |
| Metal oxide particles 10 | Rutile | Niobium | 5.0 | $1 \times 10^4$ | 170 |
| Metal oxide particles 11 | Anatase | Niobium | 5.0 | $1 \times 10^3$ | Longer axis: 340 Shorter axis: 30 |

TABLE 1-continued

| Metal oxide particles | Core Crystalline form of core material | Coating layer: Dopant of coating layer | Coating layer: Dopant content in coating layer (mass %) | Particles in a mass: Powder resistivity (Ω · cm) | Particles in a mass: Average primary particle size D1 (nm) |
|---|---|---|---|---|---|
| Metal oxide particles 12 | Anatase | Niobium | 5.0 | $7 \times 10^3$ | 220 |
| Metal oxide particles 13 | Anatase | Niobium | 5.0 | $5 \times 10^3$ | 320 |
| Metal oxide particles 14 | Anatase | Niobium | 5.0 | $9 \times 10^3$ | 110 |
| Metal oxide particles 15 | Anatase | Niobium | 5.0 | $2 \times 10^4$ | 60 |
| Metal oxide particles 16 | Anatase | Tantalum | 5.0 | $9 \times 10^3$ | 170 |
| Metal oxide particles 17 | Anatase | Niobium | 5.0 | $8 \times 10^3$ | 170 |
| Metal oxide particles 18 | Anatase | Niobium | 5.0 | $4 \times 10^5$ | 170 |
| Metal oxide particles C1 | Anatase | — | — | $1 \times 10^8$ | 150 |

Preparation of Coating Liquid for Electroconductive Layer

Electroconductive Layer-Forming Coating Liquid 1

In a mixed solution of 45 parts of methyl ethyl ketone and 85 parts of 1-butanol were dissolved binder materials: 15 parts of a butyral resin BM-1 (produced by Sekisui Chemical) and 15 parts of a blocked isocyanate resin TPA-B80E (80% solution, produced by Asahi Kasei). Into the resulting solution was added 70 parts of metal oxide particles 1, and the particles were dispersed in the solution in a vertical sand mill with 120 parts of glass beads of 1.0 mm in average diameter at a dispersion medium temperature of 23° C.±3° C. and a rotational speed of 1500 rpm (peripheral speed of 5.5 m/s) for 4 hours. The glass beads were removed from the resulting dispersion liquid by using a mesh. Then, 0.01 part of silicone oil SH28 PAINT ADDITIVE (produced by Dow Corning Toray) as a leveling agent and 5 parts of crosslinked polymethyl methacrylate (PMMA) particles Techpolymer SSX-102 (produced by Sekisui Plastics, average primary particle size: 2.5 μm, density: 1.2 g/cm$^2$) as a surface roughness agent were added into the dispersion liquid, followed by stirring. The mixture was subjected to pressure filtration through a PTFE filter PF060 (manufactured by ADVANTEC) to yield electroconductive layer-forming coating liquid 1.

Electroconductive Layer-Forming Coating Liquids 2 to 23, 25, 26, and C1

Electroconductive layer-forming coating liquids 2 to 23, 25, 26, and C1 were prepared in the same manner as electroconductive layer-forming coating liquid 1 except that the metal oxide particles and the proportion (parts) thereof were changed as shown in Table 2. For electroconductive layer-forming liquid 23, in addition, the dispersion conditions were changed such that the metal oxide particles were dispersed at a rotational speed of 2000 rpm for 10 hours.

Electroconductive Layer-Forming Coating Liquid C2

Electroconductive layer-forming coating liquid C2 was prepared in the same manner as electroconductive layer-forming coating liquid except that the metal oxide particles were replaced with particles of the anatase titanium oxide A1 containing 0. 5% by mass of niobium (primary particle size: 35 nm, surface-treated with ethyltrimethoxysilane fluoride) used in the intermediate photosensitive member 1 in Examples disclosed in Japanese Patent. Laid-Open No, 2005-17470, Electroconductive Layer-Forming Coating Liquid C3

Electroconductive layer-forming coating liquid C3 was prepared in the same manner as electroconductive layer-forming coating liquid 1 except that the metal oxide particles were replaced with flaky tin oxide particles coated with antimony-doped tin oxide (Sample U) described in Example 21 disclosed in Japanese Patent Laid-Open No. 2010-30886.

Electroconductive Layer-Forming Coating Liquid 24

In 60 parts of solvent 1-methoxy-2-propanol was dissolved 80 parts of binder that is phenol resin. (phenol resin monomer/oligomer) Plyophen J-325 (produced by DIC, resin solids content: 60%, density after being cured: 1.3 g/cm$^2$).

Into the resulting solution was added 100 parts of metal oxide particles 1, and the particles were dispersed in the solution in a vertical sand mill with 200 parts of glass beads of 1.0 mm in average diameter at a dispersion medium temperature of 23° C.±3° C. and a rotational speed of 1500 rpm (peripheral speed of 5.5 m/s) for 4 hours. The glass beads were removed from the resulting dispersion liquid by using a mesh. Then, 0.015 part of silicone oil SH28 PAINT ADDITIVE (produced by Dow Corning Toray) as a leveling agent and 15 parts of silicone resin particles Tospearl 120 (manufactured by Momentive Performance Materials, average primary particle size: 2 μm, density: 1.3 g/cm2) as a surface roughness agent were added into the dispersion liquid, followed by stirring. The mixture was subjected to pressure filtration through a PTFE filter PF060 (manufactured by ADVANTEC) to yield electroconductive layer-forming coating liquid 24.

Electroconductive Layer-Forming Coating Liquids 27 to 30 and C4

Electroconductive layer-forming coating liquids 27 to 30 and C4 were prepared in the same manner as electroconductive layer-forming coating liquid 24 except that the metal oxide particles and the proportion (parts) thereof were changed as shown in Table 2. For electroconductive layer-forming liquid 29, in addition, the dispersion conditions were changed such that the metal oxide particles were dispersed at a rotational speed of 1000 rpm for 2 hours.

Electroconductive Layer-Forming Coating Liquid C5

Electroconductive layer-forming coating liquid C5 was prepared in the same manner as electroconductive layer-forming coating liquid 24 except that the metal oxide particles were replaced with particles of the anatase titanium oxide A1 containing 0.5% by mass of niobium. (primary particle size: 35 nm, surface-treated with ethyltrimethoxysilane fluoride) used in the intermediate layer of photosensitive member 1 in Examples disclosed in Japanese Patent Laid-Open No. 2005-17470.

Electroconductive Layer-Forming Coating Liquid C6

Electroconductive layer-forming coating liquid C6 was prepared in the same manner as electroconductive layer-forming coating liquid 24 except that the metal oxide particles were replaced with flaky tin oxide particles coated with antimony-doped tin oxide (Sample U) described in Example 21 disclosed in Japanese Patent Laid-Open. No. 2010-30886.

TABLE 2

| Electro-conductive layer-forming coating liquid | Metal oxide particles | Proportion of particles (Parts) |
|---|---|---|
| Coating liquid 1 | Metal oxide particles 1 | 70 |
| Coating liquid 2 | Metal oxide particles 2 | 70 |
| Coating liquid 3 | Metal oxide particles 3 | 70 |
| Coating liquid 4 | Metal oxide particles 4 | 70 |
| Coating liquid 5 | Metal oxide particles 5 | 70 |
| Coating liquid 6 | Metal oxide particles 6 | 70 |
| Coating liquid 7 | Metal oxide particles 7 | 70 |
| Coating liquid 8 | Metal oxide particles 8 | 70 |
| Coating liquid 9 | Metal oxide particles 9 | 70 |
| Coating liquid 10 | Metal oxide particles 1 | 45 |
| Coating liquid 11 | Metal oxide particles 1 | 26 |
| Coating liquid 12 | Metal oxide particles 1 | 18 |
| Coating liquid 13 | Metal oxide particles 1 | 85 |
| Coating liquid 14 | Metal oxide particles 1 | 105 |
| Coating liquid 15 | Metal oxide particles 1 | 115 |
| Coating liquid 16 | Metal oxide particles 10 | 70 |
| Coating liquid 17 | Metal oxide particles 11 | 70 |
| Coating liquid 18 | Metal oxide particles 12 | 70 |
| Coating liquid 19 | Metal oxide particles 13 | 70 |
| Coating liquid 20 | Metal oxide particles 14 | 70 |
| Coating liquid 21 | Metal oxide particles 15 | 70 |
| Coating liquid 22 | Metal oxide particles 16 | 70 |
| Coating liquid 23 | Metal oxide particles 1 | 70 |
| Coating liquid 24 | Metal oxide particles 1 | 100 |
| Coating liquid 25 | Metal oxide particles 17 | 70 |
| Coating liquid 26 | Metal oxide particles 18 | 70 |
| Coating liquid 27 | Metal oxide particles 1 | 80 |
| Coating liquid 28 | Metal oxide particles 1 | 120 |
| Coating liquid 29 | Metal oxide particles 1 | 100 |
| Coating liquid 30 | Metal oxide particles 16 | 100 |
| Coating liquid C1 | Metal oxide particles C1 | 70 |
| Coating liquid C2 | Described in the text | 70 |
| Coating liquid C3 | Described in the text | 70 |
| Coating liquid C4 | Metal oxide particles C4 | 100 |
| Coating liquid C5 | Described in the text | 100 |
| Coating liquid C6 | Described in the text | 100 |

Preparation of Electrophotographic Photosensitive Members Electrophotographic Photosensitive Member 1

An aluminum (aluminum alloy, JIS 13003) cylinder of 257 mm in length and 24 mm in diameter manufactured in a process including extrusion and drawing was used as a support member.

Electroconductive layer-forming coating liquid 1 was applied to the surface of the support member by dip coating at normal temperature and normal humidity (23° C. and 50% RH). The resulting coating film was dried and cured by heating at 170° C. for 30 minutes to yield a 20 μm-thick electroconductive layer. The volume resistivity of the electroconductive layer was $8\times10^9$ Ω·cm.

Subsequently, 4.5 parts of N-methoxymethylated nylon resin Tresin EF-30T (produced by Nagase Chemtex) and 1.5 parts of a copolymerized nylon resin Amilan CM8000 (produced by Toray) were dissolved in a mixed solvent of 65 parts of methanol and 30 parts of n-butanol to yield an undercoat layer-forming coating liquid 1. Undercoat layer-forming coating liquid 1 was applied to the surface of the electroconductive layer by dip coating. The resulting coating film was dried at 70° C. for 6 minutes to yield a 0.85 μm-thick undercoat layer.

Subsequently, 10 parts of a crystalline hydroxygallium phthalocyanine (charge generating material) whose CuKα X-ray diffraction spectrum has peaks at Bragg angles 2θ (±0.2°) of 7°, 9.9°, 16.3°, 18.6°, 25.1° and 28.3°, 5 parts of polyvinyl butyral S-LEC BX-1 (produced by Sekisui Chemical), and 250 parts of cyclohexanone were added into a sand mill containing glass beads of 0.8 mm in diameter. The contents in the sand mill were dispersed in each other for 3 hours. Into the resulting dispersion was added 250 parts of ethyl acetate to yield a coating liquid for forming a charge generating layer. This coating liquid was applied onto the undercoat layer by dip coating. The resulting coating film was dried at 100° C. for 10 minutes to yield a 0.15 μm-thick charge generating layer.

Then, a coating liquid for forming a charge transport layer was prepared by dissolving 6.0 parts of the amine compound (charge transporting material) represented by the following formula (CT-1), 2.0 parts of the amine compound (charge transporting material) represented by the following formula (CT-2), 10 parts of bisphenol Z polycarbonate 2400 (produced Mitsubishi Engineering-Plastics), and 0.36 part of siloxane-modified polycarbonate having a repeating unit represented by the following formula (B-1) and a repeating unit represented by the following formula (B-2) with a mole ratio of (B-1):(B-2)=95:5 and having a terminal structure represented by the following formula (B-3) in a mixed solvent of 60 parts of o-xylene, 40 parts of dimethoxymethane, and 2.7 parts of methyl benzoate. The coating liquid for the charge transport layer was applied onto the surface of the charge generating layer by dip coating. The resulting coating film was dried at 125° C. for 30 minutes to yield a 12.0 μm-thick charge transport layer.

(CT-1)

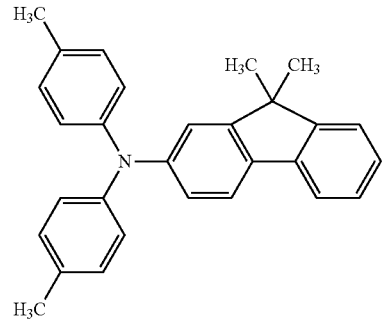

(CT-2)

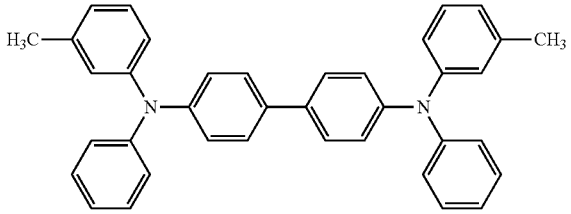

(B-1)

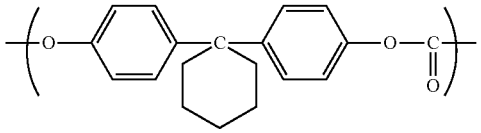

(B-2)

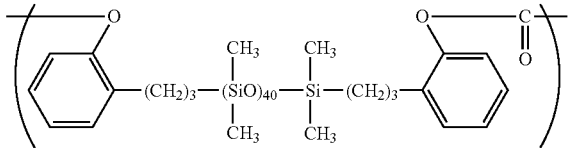

-continued (B-3)

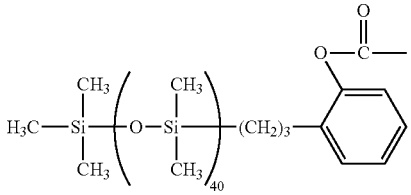

Thus, electrophotographic photosensitive member 1 having a charge transport layer as the surface layer was completed.

Electrophotographic Photosensitive Member 2 to 27, 29, 30, and C1 to C3

Electrophotographic photosensitive members 2 to 27, 29, 30, and C1 to C3, each having a charge transport layer as the surface layer, were prepared in the same manner as electrophotographic photosensitive member 1 except that the electroconductive layer-forming coating liquid 1 was replaced with the corresponding one of electroconductive layer-forming coating liquids 2 to 23, 25, 26, and C1 to C3, and that the thickness of the electroconductive layer was changed as shown in Table 3. The volume resistivity of each electroconductive layer was measured in the same manner as that of the electrophotographic photosensitive member 1. The results are shown in Table 3.

Electrophotographic Photosensitive Member 28

Electroconductive layer-forming coating liquid 1 used in the preparation of electrophotographic photosensitive member 1 was replaced with electroconductive layer-forming coating liquid 24. The coating film was dried and cured by heating at 150° C. Furthermore, the thickness of the electroconductive layer was changed as shown in Table 3. Other operation was performed in the same manner as in the preparation process of electrophotographic photosensitive member 1. Thus, electrophotographic photosensitive member 28 having a charge transport layer as the surface layer was prepared. The volume resistivity of the electroconductive layer was measured in the same manner as that of the electrophotographic photosensitive member 1. The results are shown in Table 3.

Electrophotographic Photosensitive Members 31 to 36

Electroconductive layer-forming coating liquid 1 was replaced with corresponding one of electroconductive layer-forming coating liquids 24 and 27 to 30. Furthermore, the thickness of the electroconductive layer was changed as shown in Table 3. Other operation was performed in the same manner as in the preparation process of electrophotographic photosensitive member 28. Thus, electrophotographic photosensitive members 31 to 36 having a charge transport layer as the surface layer were prepared. The volume resistivity of each electroconductive layer was measured in the same manner as that of the electrophotographic photosensitive member 1. The results are shown in Table 3

Electrophotographic Photosensitive Member 37

Electrophotographic photosensitive member 37 having a charge transport layer as the surface layer was prepared in the same manner as electrophotographic photosensitive member 28 except that the charge transport layer was formed as below.

An acid halide solution was prepared dissolving the following ingredients in dichloromethane:

41.3 g of dicarboxylic acid halide represented by the following formula:

(C-1)

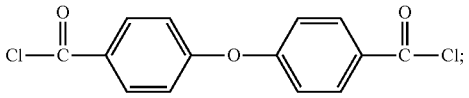

and 12.2 g of carboxylic acid halide represented by the following formula:

(C-2)

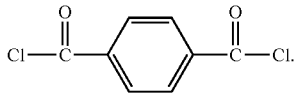

The following diols were dissolved in 10% sodium hydroxide aqueous solution:

24.2 g of diol represented by the following formula:

(D-1)

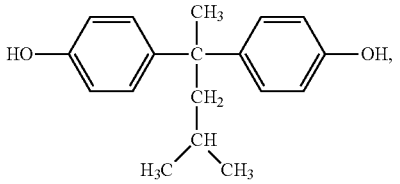

and 27 g of dial represented by the following formula:

(D-2)

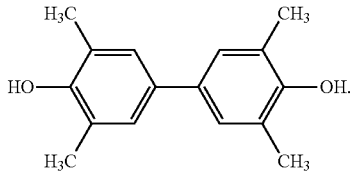

To this solution was added tributylbenzylammonium chloride as a polymerization catalyst to yield a dial compound solution.

Then, the acid halide solution was added to the diol compound solution with stirring to start a polymerization. The polymerization was made at a reaction temperature kept at 25° C. or less for 3 hours with stirring.

During the polymerization reaction, p-tert-butylphenol was added as a polymerization regulator. Then, acetic acid was added to terminate the polymerization reaction, and the reaction solution was repeatedly washed with water until the aqueous phase was turned neutral.

After washing, the dichloromethane phase was dropped into methanol to precipitate the polymerization product. The polymerization product was vacuum-dried to yield 72.3 g of polyester resin A.

The resulting polyester resin A had the structural unit represented by formula (C-1) and the structural unit represented by formula (C-2) with a mole ratio of 70:30, and the structural unit represented by formula (D-1) and the structural unit represented by formula (D-2) with a mole ratio of 50:50.The weight average molecular weight of polyester resin A was 85,000.

(CT-1)

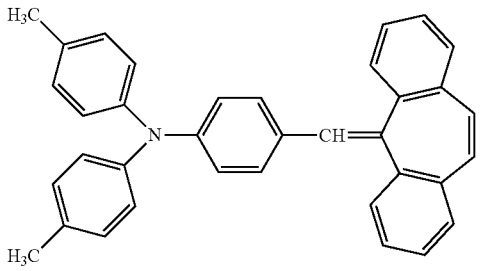

The volume resistivity of the electroconductive layer was measured in the same manner as that of the electrophotographic photosensitive member 1. The results are shown in Table 3.

Electrophotographic Photosensitive Member 38

Electrophotographic photosensitive member 38 having a charge transport layer as the surface layer was prepared in the same manner as electrophotographic photosensitive member 28 except that the charge transport layer was formed as below.

A coating liquid for forming a charge transport layer was prepared by dissolving 7.2 parts of the amine compound (charge transporting material) represented by formula (CT-1), 0.8 parts of the amine compound (charge transporting material) represented by formula CT-3), 10 parts of a polyester resin represented by the following formula (E), and 0.36 part of siloxane-modified polycarbonate having the repeating unit represented by formula (B-1) and the repeating unit represented by formula (B-2) with a mole ratio of (B-1):(B-2)=95:5 and having the terminal structure represented by formula (B-3) in a mixed solvent of 60 parts of o-xylene, 40 parts of dimethoxymethane, and 2.7 parts of methyl benzoate. In the polyester resin having the structural unit represented by formula (E), the mole ratio of the terephthalic structure to isophthalic structure was 5:5. The coating liquid for the charge transport layer was applied onto the surface of the charge generating layer by dip coating. The resulting coating film was dried at 125° C. for 30 minutes to yield a 12.0 μm-thick charge transport layer.

(E)

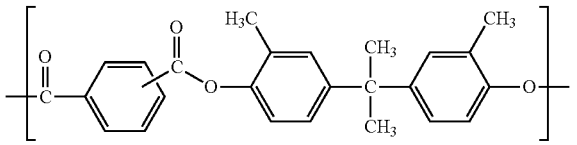

The volume resistivity of the electroconductive was measured in the same manner as that of the electrophotographic photosensitive member 1. The results are shown in Table 3.

Electrophotographic Photosensitive Member 39

Electrophotographic photosensitive member 39 having a charge transport layer as the surface layer was prepared in the same manner as electrophotographic photosensitive member 28 except that 0.36 part of the siloxane-modified polycarbonate used in the charge transport layer was replaced with 0.18 part of silicone compound GS-101 (produced by Toagosei).

The volume resistivity of the electroconductive layer was measured in the same manner as that of the electrophotographic photosensitive member 1. The results are shown in Table 3.

Electrophotographic Photosensitive Member 40

Electrophotographic photosensitive member 40 having a charge transport layer as the surface layer was prepared in the same manner as electrophotographic photosensitive member 28 except that 0.36 part of the siloxane-modified polycarbonate used in the charge transport layer was replaced with 0.54 part of siloxane-modified polycarbonate represented by the following formula (F):

(F)

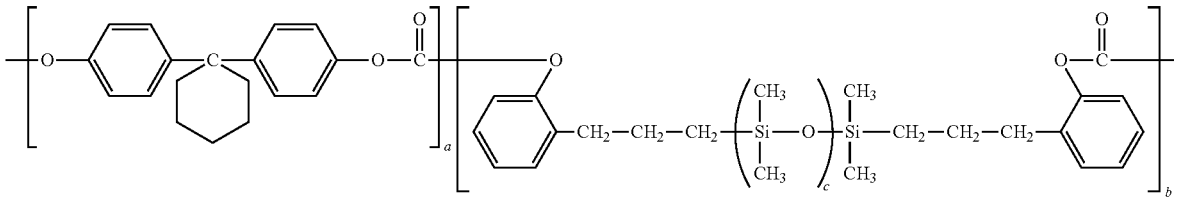

a:b = 9:1

The volume resistivity of the electroconductive layer was measured in the same manner as that of the electrophotographic photosensitive member 1. The results are shown in Table 3.

Electrophotographic Photosensitive Member 41

Electrophotographic photosensitive member 41 having a charge transport layer as the surface layer was prepared in the same manner as electrophotographic photosensitive member 40 except that the undercoat layer was formed as below.

With 500 parts of toluene was mixed 100 parts of rutile titanium oxide particles having an average primary particle size of 50 nm with stirring. After adding 3 parts of vinyltrimethoxysilane, the mixture was stirred for 8 hours. Then, after removing toluene by vacuum distillation, the product was fired at 120° C. for 3 hours to yield rutile titanium oxide particles surface-treated with vinyltrimethoxysilane.

A mixture of 4.5 parts of N-methoxymethylated nylon Tresin EF-30T (produced by Nagase Chemtex), 1.5 parts of a copolymerized nylon resin Amilan CM8000 (produced by Toray), 18 parts of the above-prepared rutile titanium oxide particles surface-treated with vinyltrimethoxysilane, 65 parts of methanol, and 30 parts of n-butanol was subjected to dispersion with 120 parts of glass beads of 1 mm in diameter with a paint shaker for 6 hours to yield a dispersion liquid. After removing the glass beads from the dispersion liquid by using a mesh, the dispersion liquid was subjected to pressure filtration through a PTFE filter PF060 (manufactured by ADVANTEC) to yield undercoat layer-forming coating liquid 2. Undercoat layer-forming coating liquid 2 was applied to the surface of the electroconductive layer by dip coating. The resulting coating film was dried at 100° C. for 10 minutes to yield a 2.0 μm-thick undercoat layer.

The volume resistivity of the electroconductive layer was measured in the same manner as that of the electrophotographic photosensitive member 1. The results are shown in Table 3.

Electrophotographic Photosensitive Member 42

Electrophotographic photosensitive member 42 having a charge transport layer as the surface layer was prepared in the same manner as electrophotographic photosensitive member 40 except that the undercoat layer was formed as below.

A solution was prepared by dissolving 8.5 parts of the compound represented by the following formula as the charge transporting material:

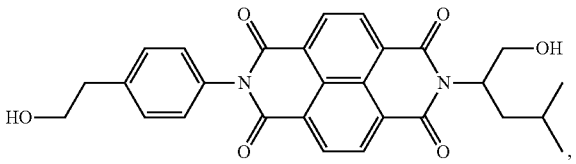

and 5 parts of a blocked isocyanate compound SBN-70D (produced by Asahi Kasei Chemicals) 0.97 part of polyvinyl alcohol resin KS-5Z (produced by Sekisui Chemical) as a resin, and 0.15 part of zinc (II) hexanoate (produced by Mitsuwa Chemicals) as a solvent in a mixed solvent of 88 parts of 1-methoxy-2-propanol and 88 parts of tetrahydrofuran. Into this solution was added 1.8 pats of a silica slurry IPA-ST-UP (produced by Nissan Chemical Industries, solids content: 15% by mass, viscosity: 9 mPa·s) containing silica particles of 9 nm to 15 nm in average primary particle size dispersed in isopropyl alcohol through nylon screen mesh sheet N-No. 150T (manufactured by Tokyo Screen). After being stirred for 1 hour, the mixture was subjected to pressure filtration through a PTFE filter PF020 (manufactured by ADVANTEC) to yield undercoat layer-forming coating liquid 3.

Undercoat layer-forming coating liquid 3 was applied to the surface of the electroconductive layer by dip coating. The resulting coating film was heated for curing (polymerization) at 170° C. for 20 minutes to yield a 0.7 μm-thick undercoat layer.

The volume resistivity of the electroconductive layer was measured in the same manner as that of the electrophotographic photosensitive member 1. The results are shown in Table 3.

Electrophotographic Photosensitive Member 43

Electrophotographic photosensitive member 43 having a charge transport layer as the surface layer was prepared in the same manner as electrophotographic photosensitive member 1 except that the undercoat layer was not formed.

The volume resistivity of the electroconductive layer was measured in the same manner as that of the electrophotographic photosensitive member 1. The results are shown in Table 3.

Electrophotographic Photosensitive Member 44

Electrophotographic photosensitive member 44 having a charge transport layer as the surface layer was prepared in the same manner as electrophotographic photosensitive member 28 except that the undercoat layer was not formed.

The volume resistivity of the electroconductive layer was measured in the same manner as that of the electrophotographic photosensitive member 1. The results are shown in Table 3.

Examples 1 to 44, Comparative Examples 1 to 6

Analysis of Electrophotographic Photosensitive Members

Five 5 mm square pieces were cut out from each of the above-prepared electrophotographic photosensitive members, and the charge transport layer and charge generating layer of each piece were removed by using chlorobenzene, methyl ethyl ketone, and methanol to expose the electroconductive layer. Thus, five samples for observation test were prepared for each electrophotographic photosensitive member.

First, for each electrophotographic photosensitive member, the electroconductive layer of one of the samples was processed to a thickness of 150 nm by FIB-μ sampling using a focused ion beam processing and observation system FB-2000A (manufactured by Hitachi High-Tech Manufacturing & Service) and was subjected to compositional analysis with a field emission electron microscope (HRTEM) JEM-2100F (manufactured by JEOL) and an energy dispersive X-ray analyzer (EDX) JED-2300T (manufactured by JEOL). The EDX analysis was performed at a voltage of 200 kV and a beam diameter of 1.0 nm.

It was confirmed that the electroconductive layers of electrophotographic photosensitive members 1 to 25 and 27 to 30 contained articles raving a titanium oxide core coated with a niobium-doped titanium oxide coating layer. Also, it was confirmed that the electroconductive layer of electrophotographic photosensitive member 26 contained particles having a titanium oxide core coated with a tantalum-doped titanium oxide coating layer. It was also confirmed that the electroconductive layer of electrophotographic photosensitive member C1 contained uncoated titanium oxide particles. It was confirmed that the electroconductive layer of electrophotographic photosensitive member C2 contained uncoated titanium oxide particles containing niobium. It was confirmed that the electroconductive layer of electrophotographic photosensitive member C3 contained particles having a tin oxide core coated with a niobium-doped tin oxide coating layer.

The diameter of the cores and the thickness of the coating layers were measured for 100 particles in the EDX image of each sample, and the average diameter Dc of the cores and the average thickness Tc of the coating layers were arithmetically calculated.

Next, the rest four samples of each electrophotographic photosensitive member were subjected to FIB-SEM Slice & View for 2 μm×2 μm×2 μm three-dimensionalization. The particle content in the electroconductive layer was determined based on contrast difference in FIB-SEM Slice & View. The Slice & View was conducted under the following conditions:

Sample processing for analysis: FIB method

Processing and observation system: NVision 40 manufactured by SII/Zeiss

Slice intervals: 10 nm

Observation conditions:

Acceleration voltage: 1.0 kV

Sample tilt: 54°

ND: 5 mm

Detector: BSE detector

Aperture: 60 μm, high current

ABC: ON

Image resolution: 1.25 nm/pixel

An area of 2 μm×2 μm of the sample was analyzed, and the volume of the particles per unit volume of 2 μm×2 μm×2 μm ($V_T$=8 $\mu m^3$) was determined by integrating information of each section. The measurement was conducted at a temperature of 23° C. and a pressure of $1\times10^{-4}$ Pa. For processing and observation, Strata 400S (sample tilt: 52°) manufactured by FBI may be used. The information of each section was obtained by image analysis of a specific area of the corresponding titanium oxide particles or electrically conductive particles. For the image analysis, an image processing software program Image-Pro Plus produced by Media Cybernetics was used.

From the obtained information, the volume (V $\mu m^3$) of titanium oxide particles (for Examples) or electrically conductive particles (for Comparative Examples) per unit volume of 2 μm×2 μm×2 μm (8 μm)) was obtained for each of the four samples, and (V ($\mu m^3$)/8 ($\mu m^3$))×100 was calculated. The ((V/8)×100) values of the four samples were averaged as the content (percent by volume) of titanium oxide particle or electrically conductive particle in the electroconductive la The results are shown in Table 3.

TABLE 3

| | | Electroconductive layer | | |
|---|---|---|---|---|
| Example No. | Electrophotographic photosensitive member | Electroconductive layer-forming coating liquid | Thickness (μm) | Particle content (vol %) in electroconductive layer |
| Example 1 | Photosensitive member 1 | Coating liquid 1 | 20 | 40 |
| Example 2 | Photosensitive member 2 | Coating liquid 2 | 20 | 40 |
| Example 3 | Photosensitive member 3 | Coating liquid 3 | 20 | 40 |
| Example 4 | Photosensitive member 4 | Coating liquid 4 | 20 | 40 |
| Example 5 | Photosensitive member 5 | Coating liquid 5 | 20 | 40 |
| Example 6 | Photosensitive member 6 | Coating liquid 6 | 20 | 40 |
| Example 7 | Photosensitive member 7 | Coating liquid 7 | 20 | 40 |
| Example 8 | Photosensitive member 8 | Coating liquid 8 | 20 | 40 |
| Example 9 | Photosensitive member 9 | Coating liquid 9 | 20 | 40 |
| Example 10 | Photosensitive member 10 | Coating liquid 10 | 20 | 30 |
| Example 11 | Photosensitive member 11 | Coating liquid 11 | 20 | 20 |
| Example 12 | Photosensitive member 12 | Coating liquid 12 | 20 | 15 |
| Example 13 | Photosensitive member 13 | Coating liquid 13 | 20 | 45 |
| Example 14 | Photosensitive member 14 | Coating liquid 14 | 20 | 50 |
| Example 15 | Photosensitive member 15 | Coating liquid 15 | 20 | 53 |
| Example 16 | Photosensitive member 16 | Coating liquid 16 | 20 | 40 |
| Example 17 | Photosensitive member 17 | Coating liquid 17 | 20 | 40 |
| Example 18 | Photosensitive member 18 | Coating liquid 1 | 30 | 40 |
| Example 19 | Photosensitive member 19 | Coating liquid 1 | 10 | 40 |
| Example 20 | Photosensitive member 20 | Coating liquid 1 | 1 | 40 |
| Example 21 | Photosensitive member 21 | Coating liquid 1 | 20 | 40 |
| Example 22 | Photosensitive member 22 | Coating liquid 18 | 20 | 40 |
| Example 23 | Photosensitive member 23 | Coating liquid 19 | 20 | 40 |
| Example 24 | Photosensitive member 24 | Coating liquid 20 | 20 | 40 |
| Example 25 | Photosensitive member 25 | Coating liquid 21 | 20 | 40 |
| Example 26 | Photosensitive member 26 | Coating liquid 22 | 20 | 40 |
| Example 27 | Photosensitive member 27 | Coating liquid 23 | 20 | 40 |
| Example 28 | Photosensitive member 28 | Coating liquid 24 | 20 | 35 |
| Example 29 | Photosensitive member 29 | Coating liquid 25 | 20 | 40 |
| Example 30 | Photosensitive member 30 | Coating liquid 26 | 20 | 40 |
| Example 31 | Photosensitive member 31 | Coating liquid 24 | 30 | 35 |
| Example 32 | Photosensitive member 32 | Coating liquid 24 | 10 | 35 |
| Example 33 | Photosensitive member 33 | Coating liquid 27 | 20 | 30 |
| Example 34 | Photosensitive member 34 | Coating liquid 28 | 20 | 39 |
| Example 35 | Photosensitive member 35 | Coating liquid 29 | 20 | 35 |
| Example 36 | Photosensitive member 36 | Coating liquid 30 | 20 | 35 |
| Example 37 | Photosensitive member 37 | Coating liquid 24 | 20 | 35 |
| Example 38 | Photosensitive member 38 | Coating liquid 24 | 20 | 35 |
| Example 39 | Photosensitive member 39 | Coating liquid 24 | 20 | 35 |
| Example 40 | Photosensitive member 40 | Coating liquid 24 | 20 | 35 |
| Example 41 | Photosensitive member 41 | Coating liquid 24 | 20 | 35 |
| Example 42 | Photosensitive member 42 | Coating liquid 24 | 20 | 35 |
| Example 43 | Photosensitive member 43 | Coating liquid 24 | 20 | 35 |
| Example 44 | Photosensitive member 44 | Coating liquid 24 | 20 | 35 |
| Comparative Example 1 | Photosensitive member C1 | Coating liquid C1 | 20 | 40 |
| Comparative Example 2 | Photosensitive member C2 | Coating liquid C2 | 20 | 40 |
| Comparative Example 3 | Photosensitive member C3 | Coating liquid C3 | 20 | 40 |
| Comparative Example 4 | Photosensitive member C4 | Coating liquid C4 | 20 | 35 |
| Comparative Example 5 | Photosensitive member C5 | Coating liquid C5 | 20 | 35 |
| Comparative Example 6 | Photosensitive member C6 | Coating liquid C6 | 20 | 35 |

| | Electroconductive layer | | | |
|---|---|---|---|---|
| Example No. | Average core diameter $D_c$ (nm) | Coating layer thickness Tc (nm) | Dc/Tc | Volume resistivity [Ω · cm] |
| Example 1 | 150 | 20 | 7.5 | $8 \times 10^9$ |
| Example 2 | 150 | 30 | 5 | $6 \times 10^9$ |
| Example 3 | 150 | 40 | 3.8 | $5 \times 10^9$ |
| Example 4 | 150 | 7.5 | 20 | $3 \times 10^{10}$ |

TABLE 3-continued

| | | | | |
|---|---|---|---|---|
| Example 5 | 150 | 5 | 30 | $1 \times 10^{11}$ |
| Example 6 | 150 | 20 | 7.5 | $8 \times 10^{10}$ |
| Example 7 | 150 | 20 | 7.5 | $5 \times 10^{11}$ |
| Example 8 | 150 | 20 | 7.5 | $4 \times 10^{9}$ |
| Example 9 | 150 | 20 | 7.5 | $1 \times 10^{9}$ |
| Example 10 | 150 | 20 | 7.5 | $4 \times 10^{10}$ |
| Example 11 | 150 | 20 | 7.5 | $5 \times 10^{11}$ |
| Example 12 | 150 | 20 | 7.5 | $1 \times 10^{12}$ |
| Example 13 | 150 | 20 | 7.5 | $5 \times 10^{9}$ |
| Example 14 | 150 | 20 | 7.5 | $1 \times 10^{9}$ |
| Example 15 | 150 | 20 | 7.5 | $8 \times 10^{8}$ |
| Example 16 | 150 | 20 | 7.5 | $1 \times 10^{10}$ |
| Example 17 | Longer axis: 300<br>Shorter axis: 20 | Longer axis: 20<br>Shorter axis: 5 | Longer axis: 15<br>Shorter axis: 4.0 | $7 \times 10^{8}$ |
| Example 18 | 150 | 20 | 7.5 | $8 \times 10^{9}$ |
| Example 19 | 150 | 20 | 7.5 | $8 \times 10^{9}$ |
| Example 20 | 150 | 20 | 7.5 | $8 \times 10^{9}$ |
| Example 21 | 150 | 20 | 7.5 | $8 \times 10^{9}$ |
| Example 22 | 200 | 20 | 10 | $7 \times 10^{9}$ |
| Example 23 | 300 | 20 | 15 | $5 \times 10^{9}$ |
| Example 24 | 100 | 10 | 10 | $9 \times 10^{9}$ |
| Example 25 | 50 | 10 | 5 | $1 \times 10^{10}$ |
| Example 26 | 150 | 20 | 7.5 | $2 \times 10^{10}$ |
| Example 27 | 150 | 20 | 7.5 | $8 \times 10^{9}$ |
| Example 28 | 150 | 20 | 7.5 | $7 \times 10^{10}$ |
| Example 29 | 150 | 20 | 7.5 | $8 \times 10^{9}$ |
| Example 30 | 150 | 20 | 7.5 | $5 \times 10^{10}$ |
| Example 31 | 150 | 20 | 7.5 | $7 \times 10^{10}$ |
| Example 32 | 150 | 20 | 7.5 | $7 \times 10^{10}$ |
| Example 33 | 150 | 20 | 7.5 | $1 \times 10^{11}$ |
| Example 34 | 150 | 20 | 7.5 | $2 \times 10^{10}$ |
| Example 35 | 150 | 20 | 7.5 | $1 \times 10^{9}$ |
| Example 36 | 150 | 20 | 7.5 | $9 \times 10^{10}$ |
| Example 37 | 150 | 20 | 7.5 | $7 \times 10^{10}$ |
| Example 38 | 150 | 20 | 7.5 | $7 \times 10^{10}$ |
| Example 39 | 150 | 20 | 7.5 | $7 \times 10^{10}$ |
| Example 40 | 150 | 20 | 7.5 | $7 \times 10^{10}$ |
| Example 41 | 150 | 20 | 7.5 | $7 \times 10^{10}$ |
| Example 42 | 150 | 20 | 7.5 | $7 \times 10^{10}$ |
| Example 43 | 150 | 20 | 7.5 | $7 \times 10^{10}$ |
| Example 44 | 150 | 20 | 7.5 | $7 \times 10^{10}$ |
| Comparative Example 1 | 150 | — | — | $1 \times 10^{14}$ |
| Comparative Example 2 | 180 | — | — | $5 \times 10^{13}$ |
| Comparative Example 3 | Longer axis: 200<br>Shorter axis: 10 | Longer axis: 20<br>Shorter axis: 2 | Longer axis: 10<br>Shorter axis: 5 | $2 \times 10^{9}$ |
| Comparative Example 4 | 150 | — | — | $1 \times 10^{14}$ |
| Comparative Example 5 | 180 | — | — | $7 \times 10^{13}$ |
| Comparative Example 6 | Longer axis: 200<br>Shorter axis: 10 | Longer axis: 20<br>Shorter axis: 2 | Longer axis: 10<br>Shorter axis: 5 | $7 \times 10^{9}$ |

Examinations

Effect of Reducing Potential Fluctuation at Dark and Bright Portions in Repeated Use Each electrophotographic photosensitive member was mounted to a laser beam printer Color LaserJet Enterprise M552 manufactured by Hewlett-Packard and subjected to durability test using printing paper at a temperature of 23° C. and a relative humidity of 50%. In this durability test, character patterns were printed with a print coverage of 2% on 5000 letter sheets in an intermittent mode in which printed sheets were outputted one by one. The charged potential (dark portion potential) and the potential when exposed to light (bright portion) were measured before starting durability test and after 5000-sheet output. For the potential measurement, a white solid pattern sheet and a black solid pattern sheet were used. From the initial dark portion potential Vd (at the beginning of durability test), the initial bright portion potential V1 (at the beginning of durability test), the dark port ton potential Vd' after 5000-sheet output, and the bright portion potential V1' after 5000-sheet output, the difference between the initial dark portion potential Vd and the dark portion potential Vd' after 5000-sheet output, ΔVd (=|Vd|−|Vd'|), and the difference between the initial bright portion potential V1 and the bright portion potential. V1' after 5000-sheet output, ΔV1 (=|V1'|−|V1|), were obtained. The results are shown in Table 4.

Definition of Output Image

For this evaluation, a laser beam printer Color LaserJet Enterprise M552 (manufactured by Hewlett-Packard) modified as below was used as the testing electrophotographic apparatus. More specifically, the printer was modified sa that the charging conditions and the amount of laser exposure could be varied. Also, the printer was modified so as to be operable in a state where the black process cartridge to which any of the above-prepared electrophotographic photosensitive members was mounted was attached to the station of the black process cartridge of the printer while the process cartridges for the other colors (cyan, magenta, and yellow) were not attached. For outputting images, only the black process cartridge was mounted to the laser beam printer, and black single-color images were output. The laser beam intensity was adjusted so that the dark portion potential Vd would be −600 V; the bright portion potential V1 would be −250 V; and the developing bias Vdc applied to the charging member would be −450 V.

Figure 4:
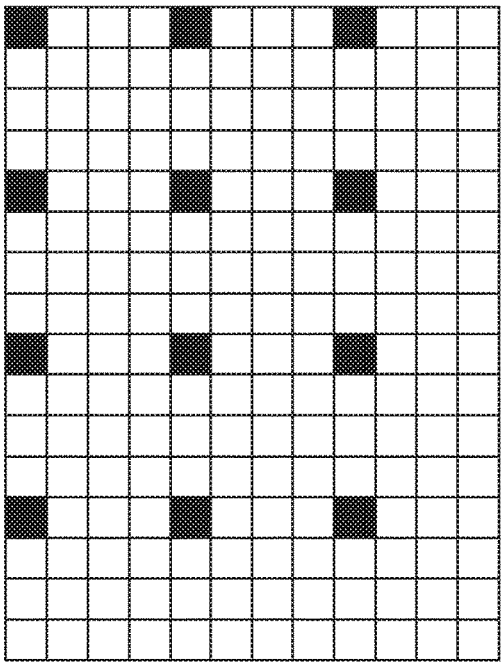
FIG. 4 is an illustrative representation of an image pattern including dots formed by exposure at three-dots intervals, according to one or more aspect of the subject disclosure.

The definition of output images was evaluated based on the density of an output image (pattern of separated dots), shown in FIG. 4, formed by exposure at three-dots intervals at a temperature of 23° C. and a relative humidity of 50%. If a latent image of the separated. dot pattern has been formed on the electrophotographic photosensitive member, the separated dots are clearly output on a paper sheet, and thus, a high-density image is outputted. If a latent image of the separated dot pattern has not been formed on the electrophotographic photosensitive member, the separated dots are not clear output on a paper sheet, and thus, a low-density image is outputted. The definition of output images can be evaluated based on how high or low the density of output image is.

The density of an output image was calculated from the difference in whiteness of the output image between the exposed dot portions and the unexposed dot portions (white portions). The density of output images was measured with a white light photometer (TC-6DS/A, manufactured by Tokyo Denshoku, using an umber filter). When the density of an output image was 8.0% or more, the definition of the output image was determined to be high. The results are shown in Table 4.

TABLE 4

| Example No. | Effect of reducing potential fluctuation in repeated use ΔVD (V) | ΔVL (V) | Definition of output image Output image density (%) |
|---|---|---|---|
| Example 1 | 10 | 10 | 11.0 |
| Example 2 | 8 | 8 | 11.0 |
| Example 3 | 8 | 8 | 10.0 |
| Example 4 | 15 | 20 | 11.0 |
| Example 5 | 40 | 50 | 10.5 |
| Example 6 | 20 | 25 | 11.0 |
| Example 7 | 40 | 80 | 11.0 |
| Example 8 | 5 | 5 | 10.5 |
| Example 9 | 5 | 5 | 10.0 |
| Example 10 | 20 | 20 | 11.0 |
| Example 11 | 30 | 40 | 10.5 |
| Example 12 | 60 | 80 | 10.0 |
| Example 13 | 15 | 15 | 11.2 |
| Example 14 | 20 | 20 | 11.4 |
| Example 15 | 30 | 30 | 11.5 |
| Example 16 | 20 | 20 | 11.0 |
| Example 17 | 3 | 3 | 9.0 |
| Example 18 | 12 | 16 | 11.5 |
| Example 19 | 8 | 8 | 10.5 |
| Example 20 | 4 | 4 | 9.5 |
| Example 21 | 4 | 4 | 11.0 |
| Example 22 | 10 | 10 | 11.0 |
| Example 23 | 10 | 10 | 11.0 |
| Example 24 | 10 | 12 | 10.0 |
| Example 25 | 14 | 14 | 9.3 |
| Example 26 | 10 | 10 | 11.0 |
| Example 27 | 30 | 30 | 11.0 |
| Example 28 | 15 | 15 | 11.0 |
| Example 29 | 10 | 10 | 11.0 |
| Example 30 | 25 | 25 | 11.0 |
| Example 31 | 17 | 20 | 11.5 |
| Example 32 | 14 | 13 | 10.5 |
| Example 33 | 20 | 20 | 10.8 |
| Example 34 | 10 | 10 | 11.1 |
| Example 35 | 5 | 5 | 11.0 |

TABLE 4-continued

| Example No. | Effect of reducing potential fluctuation in repeated use ΔVD (V) | ΔVL (V) | Definition of output image Output image density (%) |
|---|---|---|---|
| Example 36 | 18 | 18 | 11.0 |
| Example 37 | 30 | 30 | 11.0 |
| Example 38 | 30 | 30 | 11.0 |
| Example 39 | 30 | 30 | 11.0 |
| Example 40 | 30 | 30 | 11.0 |
| Example 41 | 30 | 30 | 11.0 |
| Example 42 | 30 | 30 | 11.0 |
| Example 43 | 110 | 35 | 11.0 |
| Example 44 | 120 | 40 | 11.0 |
| Comparative Example 1 | 200 | 250 | 8.0 |
| Comparative Example 2 | 150 | 200 | 8.0 |
| Comparative Example 3 | 5 | 5 | 7.0 |
| Comparative Example 4 | 200 | 250 | 8.0 |
| Comparative Example 5 | 150 | 200 | 8.0 |
| Comparative Example 6 | 7 | 8 | 7.0 |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-037735 filed Feb. 28, 2017, which is here y incorporated by reference herein in its entirety.

What is claimed is:

1. An electrophotographic photosensitive member comprising:

a support member;

an electroconductive layer; and a photosensitive layer in this order, wherein the electroconductive layer contains a binder and particles having a core containing titanium oxide, and a coating layer coating the core and containing titanium oxide doped with niobium or tantalum.

2. The electrophotographic photosensitive member according to claim 1, wherein the content of the particles in the electroconductive layer is in the range of 20% by volume to 50% by volume relative to tba total volume of the electroconductive layer.

3. The electrophotographic photosensitive member according to claim 1, wherein the core contains anatase titanium oxide.

4. The electrophotographic photosensitive member according to claim 1, wherein the niobium or tantalum content in the coating layer is in the range of 0.5% by mass to 10.0% by mass relative to the total mass of the coating layer.

5. The electrophotographic photosensitive member according to claim 1, wherein the core has an average diameter in the range of 5 times to 20 times the average thickness of the coating layer.

6. A process cartridge capable of being removably attached to an electrophotographic apparatus, the process cartridge comprising:

an electrophotographic photosensitive member; and at least one device selected from the group consisting of a charging device, a developing device, a transfer device, and a cleaning device, the at least one device being held together with the electrophotographic photosensitive member in one body, wherein the electrophotographic photosensitive member includes a support member, an electroconductive layer, and a photosensitive layer in this order, the electroconductive layer containing a binder and particles having a core containing titanium oxide, and a coating layer coating the core and containing titanium oxide doped with niobium or tantalum.

7. An electrophotographic apparatus comprising:

an electrophotographic photosensitive member;

a charging device;

an exposure device;

a developing device; and a transfer device, wherein the electrophotographic photosensitive member includes a support member, an electroconductive layer, and a photosensitive layer in this order, the electroconductive layer containing a binder and particles having a core containing titanium oxide, and a coating layer coating the core and containing titanium oxide doped with niobium or tantalum.

* * * * *